United States Patent [19]

Lyons

[11] 4,407,260

[45] Oct. 4, 1983

[54] ARCHERY BOWSTRING RELEASE DEVICE

[76] Inventor: Leon W. Lyons, 1122 Dewitt Ave., Niles, Mich. 49120

[21] Appl. No.: 210,121

[22] Filed: Nov. 24, 1980

Related U.S. Application Data

[62] Division of Ser. No. 62,701, Aug. 1, 1979, Pat. No. 4,282,851.

[51] Int. Cl.[3] ..... F41B 5/00

[52] U.S. Cl. ..... 124/35 A; 124/40

[58] Field of Search ..... 124/35 A, 35 R, 24 R, 124/41 A

[56] References Cited

U.S. PATENT DOCUMENTS 2,488,597 11/1949 Konold ..... 124/35 A 2,819,707 1/1958 Kayfes et al. ..... 124/35 A 4,105,011 8/1978 Chism ..... 124/35 A

*Primary Examiner*—Richard C. Pinkham

*Assistant Examiner*—William R. Browne

*Attorney, Agent, or Firm*—James D. Hall

[57] ABSTRACT

A release device for aid in drawing and quickly releasing the string of a bow to facilitate accurate launching of an arrow.

A manually shiftable member is carried by the housing of the device, and has a cam projection positioned between the legs of spring-urged string-retaining jaws. The member is pivotable between a position holding the jaws in string-retaining relation and a position permitting a spring to separate the jaws to string-releasing relation.

3 Claims, 9 Drawing Figures

ARCHERY BOWSTRING RELEASE DEVICE

This application is a division of application Ser. No. 62,701 filed Aug. 1, 1979, now U.S. Pat. No. 4,282,851.

SUMMARY OF THE INVENTION

This invention relates to a release device by which an archer may draw and quickly release the string of a bow. Many prior devices of this character have been designed in the past. For the most part these devices have had disadvantages as they were expensive, complex, difficult to operate, or failed to achieve an increase in accuracy over the traditional finger release method of launching an arrow from a long bow.

In the release device of this invention, a housing pivotally carries a pair of opposed matched jaws which project from the housing. The jaws are pivoted between a locked position in which they are juxtaposed and define a bowstring retainer and a release position in which the jaws are separated to release the string. A spring urges the jaws toward their release position. The release device includes a trigger pivotally carried by the housing and positioned between legs of the jaws. The trigger is shiftable between a first position in which projections thereof engage the jaws to retain the jaws in string retaining position and a second position in which said projections permit release of the jaws by jaw springs. The trigger includes an operating lever which projects from the housing and is readily accessible to the archer.

In another embodiment of the release device a trigger is pivotally carried by the housing and includes a projection which is interposed between the legs of the jaws when in one position to retain the jaws in string retaining position. When the trigger is shifted to a second position, its projection is disengaged from the jaw legs so that the jaws may be pivoted by a spring to a release position. This embodiment of the release also includes a safety latch which is slidable within the housing and between the jaw legs and which is shiftable between a string retaining position and a release position. The safety latch includes a part which projects from apertures of the housing to be manually controlled or adjusted. The position of the projection indicates whether the safety latch is operative or is released to condition the device for string release by operation of the trigger. The safety latch may be urged by a spring to its release position.

In both embodiments of the release device the housing includes means to conveniently connect a lanyard which may be connected to a wrist strap worn by an archer.

It is an object of this invention to provide an archery release device which permits accurate aim and release of a bowstring with minimum twisting, deflecting or vibrating of the string.

Another object is to provide a release device which is simple in construction, inexpensive to produce and convenient in use.

Another object is to provide a device which releases a bowstring in response to the movement of a trigger by a finger of the archer.

Another object is to provide a release device which avoids binding of the mechanism and provides a smooth release action.

Other objects will be apparent from a reading of the following specification.

DETAIL DESCRIPTION OF THE PREFERRED EMBODIMENTS

The preferred embodiments illustrated are not intended to be exhaustive nor to limit the invention to the precise form disclosed. They are chosen and described to explain the principles, application and practical use of the invention and to thereby better enable others skilled in the art to utilize the invention.

Figure 1A:
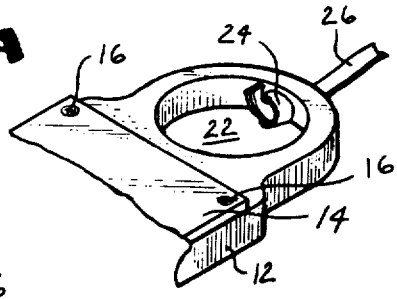
FIG. 1A is a fragmentary perspective view of the knotted end of a lanyard which is received in a hole of the release device.
Figure 1:
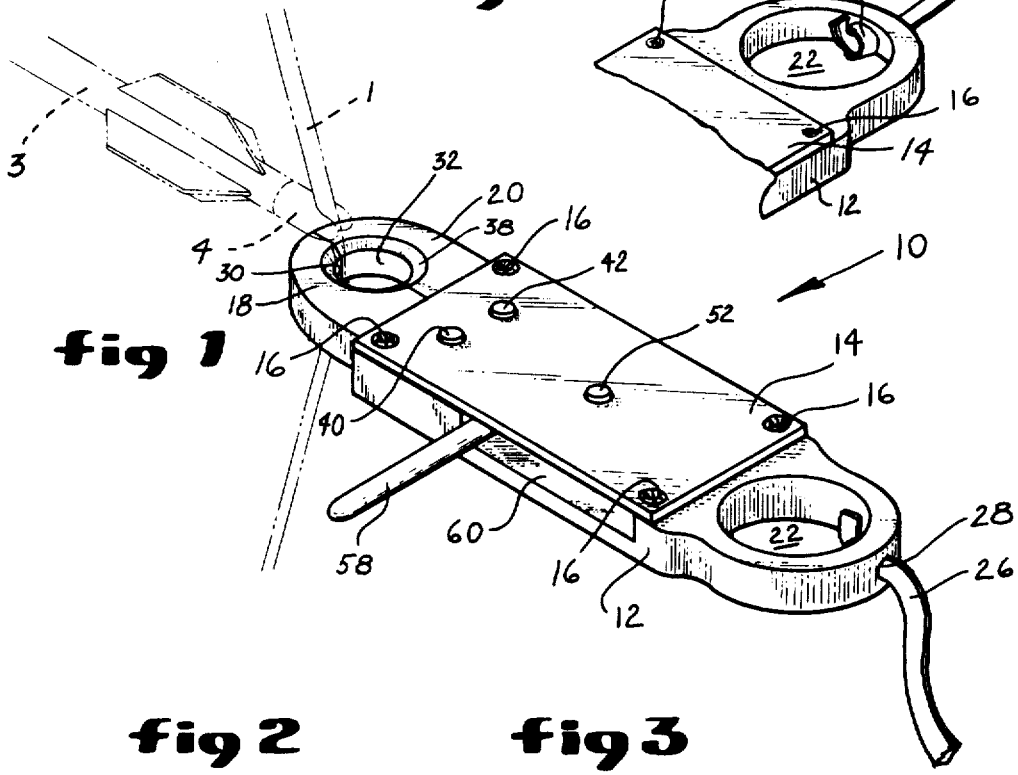
FIG. 1 is a fragmentary perspective view of the release device engaged with a drawn string of an archery bow with which an arrow is nocked.
Figure 2:
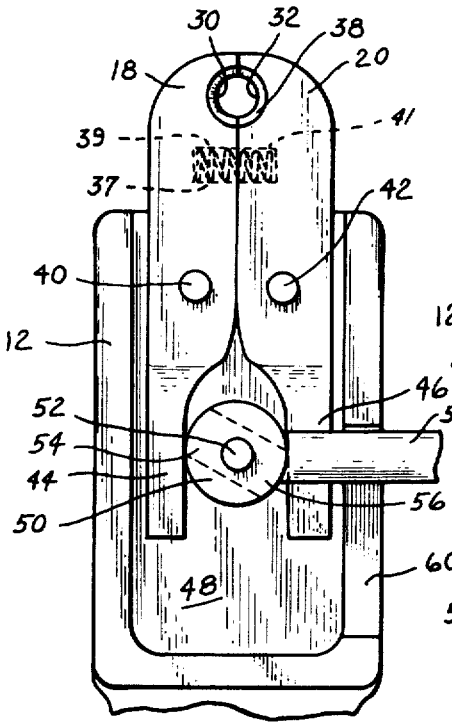
FIG. 2 is a sectional view of one embodiment of the release device with the jaws thereof shown in string retaining position.
Figure 3:
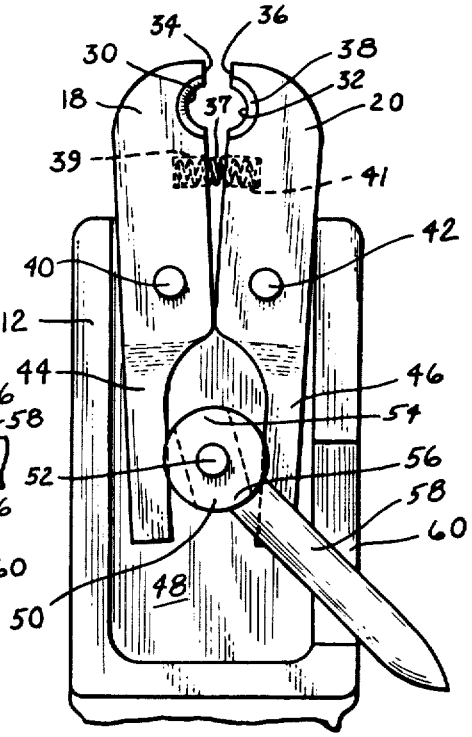
FIG. 3 is a sectional view similar to FIG. 2 showing the jaws in release position.
Figure 4:
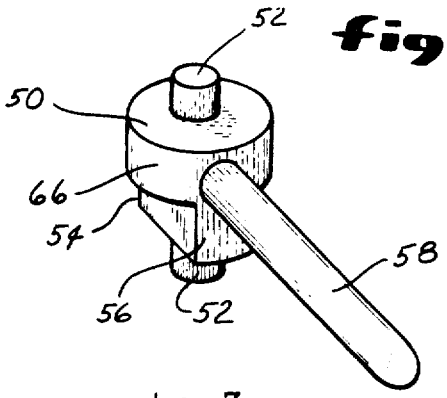
FIG. 4 is a perspective view of the trigger of the device shown in FIGS. 2 and 3.

With reference to FIG. 1, the number 10 designates a bowstring release device which is engaged with the string 1 of an archery bow (not shown) to which string an arrow 3 is engaged at its nock 4. The release device 10 includes a housing 12 having a cover plate 14 secured thereto as by rivets 16. Housing 12 pivotally carries a pair of opposed jaws 18 and 20 which project therefrom at one end. Housing 12 preferably includes a hole 22 at its opposite end for receiving the knot 24 of a lanyard 26 which passes through a hole 28 communicating with hole 22. Jaws 18 and 20 have notches 30 and 32 in the confronting faces 34 and 36 of their projecting ends. Notches 30 and 32 are preferably chamfered at 38. Jaws 18 and 20 are pivotally connected to housing 12 by pins 40 and 42 which pass through the jaws and fit in holes in the housing 12 and in cover plate 14. The jaws are shiftable between a locked or string retaining position as viewed in FIG. 2, and a release position, as viewed in FIG. 3, in which the notched ends of the jaws are separated. A coil spring 37 whose ends are received in holes 39, 41 in the jaws continuously urges the jaws to their release position. Jaws 18 and 20 include inner end portions 44, 46 within the chamber 48 of housing 12.

A trigger 50 is pivoted by a pin 52 within chamber 48 of housing 12 at a position between the legs 44, 46 of jaws 18, 20. Trigger 50 has radial projections 54, 56 positioned between the legs 44, 46 of jaws 18, 20. In the FIG. 2 position the projections 54, 56 retain the jaws in locked or string retaining position. In the trigger position shown in FIG. 3, radial projections 54, 56 entend generally parallel to legs 44, 46 of the jaws to permit the projecting ends of the jaws to separate to release position. Trigger 50 includes a lever 58 which projects from the chamber 48 through a slot 60 of housing 12 and to an accessible position projecting from the housing. Jaw legs 44, 46 are preferably reduced in thickness to accommodate the body 66 of trigger 50 from which projections 54, 56 extend.

A second embodiment of the release device is shown in FIGS. 5–8 wherein parts analogous in function are referred to with the same numbers used in FIGS. 1–4. In this embodiment, a trigger 68 is pivoted to housing 12 intermediate its ends by a pin 70 and passes through an opening 78 in the housing 12. The inner end of trigger 68 includes a projection 71 which has converging or angulated shoulders 72, 74 which fit between the inner ends of legs 44, 46 of the jaws 18, 20, in one position of the trigger. In a second position of the trigger, shown in FIG. 6, the trigger projection 71 swings clear of the jaw legs 44, 46 so that the spring 37 may separate the projecting ends of the jaw.

Figure 5:
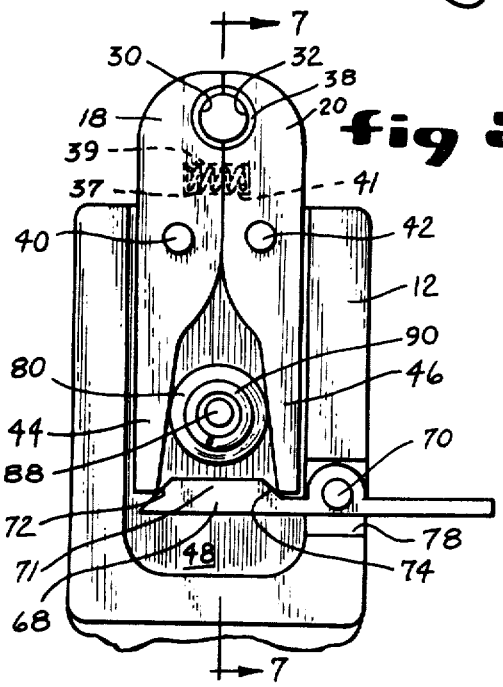
FIG. 5 is a sectional view of another embodiment of the release device.
Figure 6:
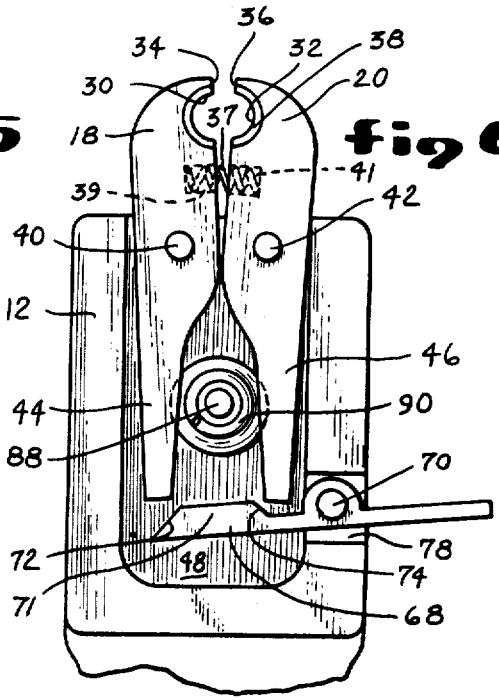
FIG. 6 is a sectional view similar to FIG. 5 showing the jaws in release position.
Figure 7:
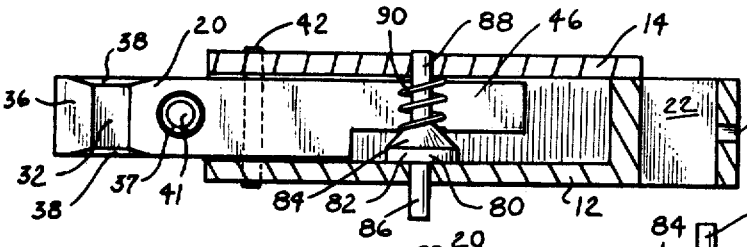
FIG. 7 is a sectional view taken along line 7—7 of FIG. 5 and illustrating a safety latch shown in fire position.
Figure 8:
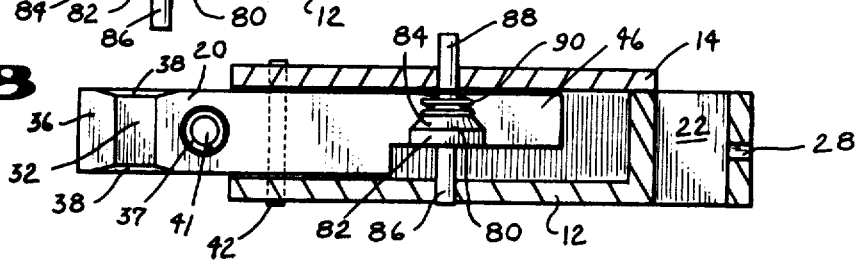
FIG. 8 is a sectional view similar to FIG. 7 illustrating the safety latch in retaining position.

A safety latch 80 is slidable within housing 12 between the legs 44, 46 of jaws 18, 20. Safety latch 80 includes an enlarged part 82 having a tapering or frustoconical part 84 and elongated end parts 86, 88 which project through and are slidable in holes in housing 12. As best seen in FIG. 5, the size of enlargement 82 is correlated to the space between jaw legs 44, 46 when jaws 18, 20 are in their string retaining or locked position. Enlargement 82 of safety latch 80 is shiftable endwise within chamber 48 between a safe or retaining position, as shown in FIG. 8, in which the jaws are held in string retaining position, and a fire or "ready" position, as shown in FIG. 7, in which enlargement 82 is clear of jaw ends 44, 46. A spring 90 holds safety latch 80 in its "ready" position.

The use of this release device involves its engagement with a bowstring at notches 30, 32 of jaws 18, 20. An archer may then draw the bow by grasping and pulling the release. In using the FIGS. 2–4 embodiment of the release device, the archer takes aim, and releases the bowstring and arrow by flexing a finger to pivot lever 58 slightly toward the rear of the release, i.e. from FIG. 2 position to FIG. 3 position. The radial projections 54, 56 of trigger 50 are thus shifted to release the jaw legs whereupon the jaws shift to their release position under the influence of spring 37 and of the tension in the bowstring. As the jaws 18, 20 separate, the bowstring moves forward through the clearance space between the jaws without being deflected from its course or twisted, or oscillated.

The use of the embodiment of the release device shown in FIGS. 5–8, entails positioning of lever 68 with its projection between the jaw ends 44, 46 and positioning of head 82 of the safety latch between jaw ends 44, 46 after engaging the notched jaws ends with the bowstring. As the archer takes aim, he shifts the safety latch to its "ready" position shown in FIG. 7 while the projection faces 72, 74 of trigger 68 separate jaw ends 44, 46. After drawing and aiming the bow, the archer need only straighten his finger to release the trigger and permit spring 37 to separate the jaws and release the bowstring.

It is to be understood that this invention is not to be limited to the precise form disclosed, but that it may be modified within the scope of the appended claims.

What I claim is:

1. An archery bowstring release device comprising a housing, jaws pivoted intermediate their ends to said housing and having ends projecting from said housing and said ends provided with confronting string-receiving notches, spring means normally separating the projecting ends of said jaws, said jaws being shiftable between a string-retaining position and a string-releasing position, each of said jaws including an elongated leg within the housing, and manually shiftable means pivotally connected to said housing and having a part projecting from said housing, said shiftable means including a member having radial projections positioned between and engaging said jaws in a string retaining first position during bowstring drawing and aiming, said member being pivotable to a second position upon rotation of said shiftable means to disengage said radial projections from the jaws whereby said projecting string-engaging jaw ends may be spring-released and separated.

2. The archery bowstring release device of claim 1 wherein said shiftable means includes a trigger pivoted at one end to said housing and said radial projections include cam surfaces and said radial projections are rotatable about an axis within said housing whereby said cam surfaces urge said jaws to their string-retaining position in one trigger position and retract from the jaws to permit spring release and separation of the projecting string-engaging jaw ends in a second trigger position.

3. The archery bowstring release device of claim 1 wherein said shiftable means includes a trigger pivotally connected to said housing and said radial projections are rotatable about the pivot axis of said trigger whereby said projections are engageable with and between said jaw legs to retain said jaws in string-retaining position in one trigger position, said trigger being shiftable to position and projections out of engagement with said jaw legs.

* * * * *